US006732394B1

(12) United States Patent
Waterman

(10) Patent No.: US 6,732,394 B1
(45) Date of Patent: May 11, 2004

(54) POSITIONABLE BODY SCRUBBING DEVICE

(76) Inventor: Charles W. Waterman, 207 E. Cedarwood Cir., Kissimmee, FL (US) 34743

( * ) Notice: Subject to any disclaimer, the term of this patent is extended or adjusted under 35 U.S.C. 154(b) by 47 days.

(21) Appl. No.: 10/077,109

(22) Filed: Feb. 19, 2002

(51) Int. Cl.[7] ..... A47K 7/04
(52) U.S. Cl. ..... 15/97.1; 4/606
(58) Field of Search ..... 15/28, 21.1, 97.1; 4/606; 601/136

(56) References Cited

U.S. PATENT DOCUMENTS 2,827,794 A * 3/1958 Weimersheimer
3,115,322 A * 12/1963 Fleming
4,151,623 A * 5/1979 Steere
4,228,557 A * 10/1980 De Vivo
4,420,850 A * 12/1983 Moore
4,432,113 A * 2/1984 Gouge
4,696,068 A * 9/1987 Kenner
5,239,712 A * 8/1993 Kinder
5,345,640 A * 9/1994 Goss
5,382,221 A * 1/1995 Hsu
5,415,621 A * 5/1995 Campbell
5,450,647 A * 9/1995 Dorsey
5,561,869 A * 10/1996 Sarel
5,628,083 A * 5/1997 Hayes
5,704,903 A * 1/1998 Jahnke
5,836,035 A * 11/1998 McElfish
5,891,063 A * 4/1999 Vigil
6,053,464 A * 4/2000 Cardarelli
6,058,545 A * 5/2000 Roach
6,401,289 B1 * 6/2002 Herbert

* cited by examiner

*Primary Examiner*—Randall Chin

(57) ABSTRACT

A positionable body scrubbing device for scrubbing various parts of a user's body. The positionable body scrubbing device includes a housing that has an interior and first and second opposed ends. A motor having a motor shaft is mounted in the interior of the housing. A power supply is mounted in the housing and electrically connected to the motor for selectively providing power to the motor. An actuator is mounted on the housing and electrically connected to the motor for selectively controlling the motor. A securing assembly designed for securing the housing to the wall surface is mounted to the second end of the housing. A cleaning assembly is rotatably mounted to the motor shaft, wherein a user presses their body against the cleaning assembly.

1 Claim, 3 Drawing Sheets

POSITIONABLE BODY SCRUBBING DEVICE

BACKGROUND OF THE INVENTION

1. Field of the Invention

The present invention relates to scrubbers and more particularly pertains to a new positionable body scrubbing device for scrubbing various parts of a user's body.

2. Description of the Prior Art

The use of scrubbers is known in the prior art. More specifically, scrubbers heretofore devised and utilized are known to consist basically of familiar, expected and obvious structural configurations.

Known prior art includes U.S. Pat. No. 5,704,903; U.S. Pat. No. 5,500,972; U.S. Pat. No. 5,600,864; U.S. Pat. No. 6,170,108; U.S. Pat. No. 5,893,836; U.S. Pat. No. 6,165,145; and U.S. Pat. No. 5,569,168.

Scrubbers have been known in the prior art. However, these devices are typically handheld. Although these devices may be effective for their intended purpose, users with disabilities such as arthritis, which affects their ability to grasp the device, find them difficult to manipulate. Motorized handheld scrubbers are also known, however, these devices also require a user to grasp the device.

Scrubbers that are mountable to a wall surface are also known in the prior art. However, these devices are generally not repositionable limiting their use to a particular body part. Additionally, these devices lack a motor requiring a user to move their body with respect to the device to be used.

SUMMARY OF THE INVENTION

In view of the foregoing disadvantages inherent in the known types of scrubbers now present in the prior art, the present invention provides a new positionable body scrubbing device construction wherein the same can be utilized for scrubbing various parts of a user's body.

The general purpose of the present invention, which will be described subsequently in greater detail, is to provide a new positionable body scrubbing device which has many of the advantages of the scrubbers mentioned heretofore and many novel features that result in a new positionable body scrubbing device which is not anticipated, rendered obvious, suggested, or even implied by any of the prior art scrubbers, either alone or in any combination thereof.

While the conventional devices fulfill their respective, particular objectives and requirements, the aforementioned patents do not disclose a new positionable body scrubbing device. The inventive device includes a housing that has an interior and first and second opposed ends. A motor having a motor shaft is mounted in the interior of the housing. A power supply is mounted in the housing and electrically connected to the motor for selectively providing power to the motor. An actuator is mounted on the housing and electrically connected to the motor for selectively controlling the motor. A securing assembly designed for securing the housing to the wall surface is mounted to the second end of the housing. A cleaning assembly is rotatably mounted to the motor shaft, wherein a user presses their body against the cleaning assembly.

An object of the present invention is to provide a new positionable body scrubbing device that is motorized and removably mountable to a wall surface.

Another object of the present invention is to provide a new positionable body scrubbing device that permits a user with limited mobility to wash and massage hard to reach body parts.

There has thus been outlined, rather broadly, the more important features and objects of the positionable body scrubbing device in order that the detailed description thereof that follows may be better understood, and in order that the present contribution to the art may be better appreciated.

Before explaining at least one embodiment of the invention in detail, it is to be understood that the invention is not limited in its application to the details of construction and to the arrangements of the components set forth in the following description. Additionally, the present invention is not limited to the construction illustrated in the drawings. The invention is capable of other embodiments and of being practiced in various ways. Also, it is to be understood that the phraseology and terminology employed herein are for the purpose of description and should not be regarded as limiting. Therefore, the claims should be regarded as including such equivalent constructions.

BRIEF DESCRIPTION OF THE DRAWINGS

The drawings of the preferred embodiment annexed herein include.

DESCRIPTION OF THE PREFERRED EMBODIMENT

Figure 1:
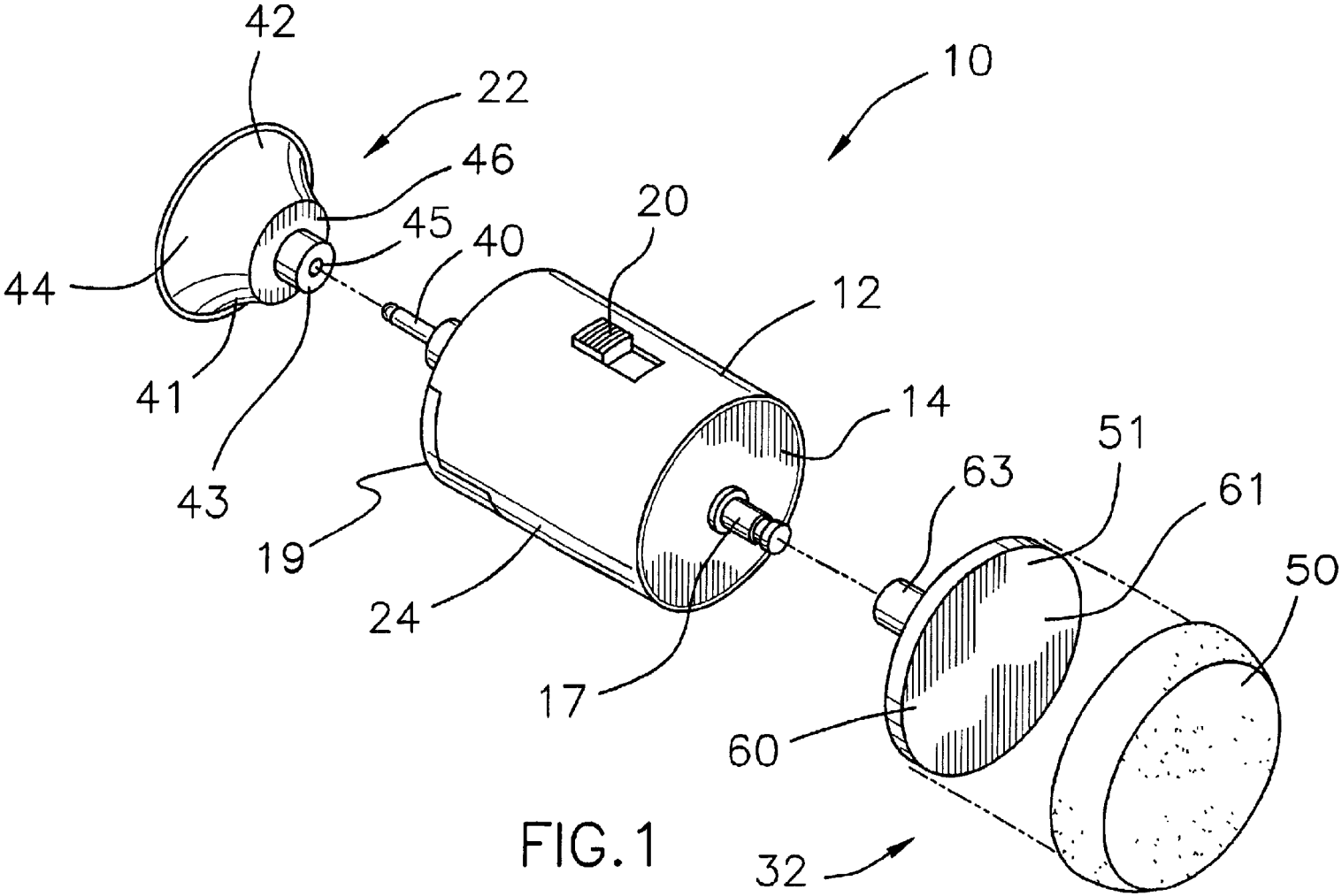
FIG. 1 is an exploded perspective view of a new positionable body scrubbing device according to the present invention.

Referring to FIG 1, a new positionable body scrubbing device is designated by the reference numeral 10. The positionable body scrubbing device 10 generally comprises a housing 12 that has an interior 13 and first 14 and second 15 opposed ends. A motor 16 having a motor shaft 17 is mounted in the interior 13 of the housing 12 with the motor shaft 17 extending axially through the first end 14 of the housing 12. A power supply 18 may be mounted in the interior 13 of the housing 12 and may be electrically connected to the motor 16 for selectively providing power thereto. As illustrated in FIG. 1, an actuator 20 is mounted on the housing 12 and may be electrically connected to the motor 16 for selectively controlling a rotational speed of the motor shaft 17. To secure the housing 12 to a wall surface a securing assembly 22 is mounted to the second end 15 of the housing 12. Additionally, to clean or massage a user's body, a cleaning assembly 32 is rotatably mounted to the motor shaft 17, wherein a user presses their body against the cleaning assembly 32. As particularly illustrated in FIG. 1, the housing 12 may have a generally circular transverse cross section taken substantially perpendicular to a longitudinal axis of the housing 12. However, the housing 12 may employ any cross sectional shape such as, for example, square, rectangular and oval. The housing 12 may comprise a substantially rigid material such as, for example, a plastic. However, other materials may also be employed. The housing 12 is preferably water resistant such that moisture is prevented from entering the interior 13 of the housing 12, thereby permitting the housing to be positioned in a shower area. Conventional means may be employed to make the housing 12 water resistant.

Figure 2:
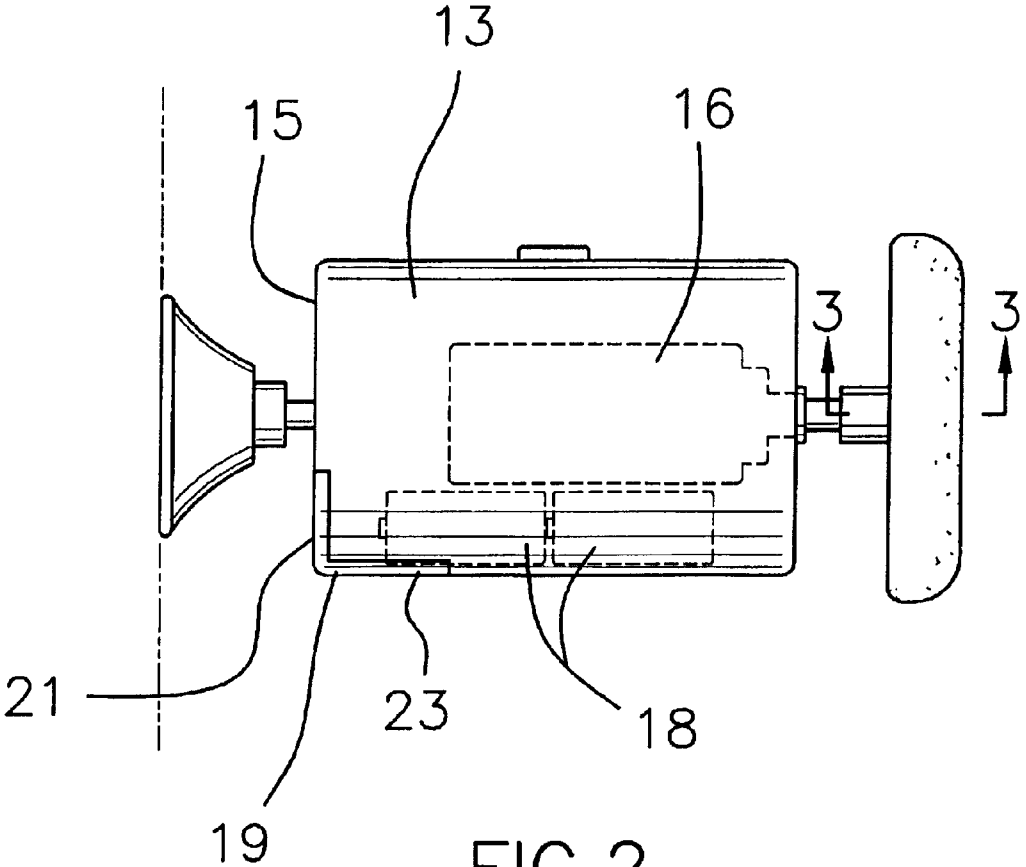
FIG. 2 is a side view of the present invention.

As illustrated in FIG. 2, a door 19 may be mounted on the housing 12 for accesses the interior 13 thereof. The door 19 may include a foot portion 21 and a leg portion 23 orientated generally perpendicular to each other. The foot portion 21 may be orientated such that it lies in the same plane as and engages the second end 15 of the housing 12. The leg portion 23 may be orientated such that it lies in a plane of and engages a peripheral wall 24 of the housing 12. The power supply 18 may be positionable in the interior 13 of the housing 12 through the door 19.

The motor 16 may comprise a conventional motor designed for rotational movement of the motor shaft 17. The motor 16 may also comprise a conventional motor designed for rotating the motor shaft 17 at various rotational speeds.

The power supply 18 may comprise at least one battery positioned generally adjacent to the peripheral wall 24 of the housing 12. As illustrated in FIG. 2, a pair of batteries may also be employed. The power supply 18 is not limited to any particular type and conventional batteries may be employed. Electrical contacts may be mounted in the interior 13 of the housing 12 for selectively contacting the power supply 18 and electrically connecting the power supply 18 to the motor 16. The electrical contacts may be mounted to an inner surface of the peripheral wall 24 and an inner surface of the door 19.

The actuator 20 may comprise a switch that is mounted on the peripheral wall 24 of the housing 12. The switch may be designed for sliding, with respect to the housing 12, between various positions. Each of the positions preferably relates to a particular rotational speed of the motor shaft 17. Other types of actuators may also be employed such as, for example, depressible and toggle switches.

In one embodiment of the present invention, as illustrated in FIGS. 1 and 2, the securing assembly 22 may include a shaft 40 that is mounted to and extends axially away from the second end 15 of the housing 12. The shaft 40 may include a bulbous end portion having an outer diameter generally greater than the rest of the shaft 40. The securing assembly 22 may additionally include a securing member 41 that has a suction portion 42 for suctioning to the wall surface and a coupling portion 43 for coupling the suction portion 42 to the housing 12.

The suction portion 42 may include an end wall 46 and a peripheral wall 44 extending away therefrom. The suction portion 42 of the securing member has an outer diameter that generally increases from the end wall 46 to an edge of the peripheral wall 44. The suction portion 42 of the securing assembly 22 may comprise a substantially flexible material such as, for example, a plastic or rubber material.

The coupling portion 43 has an end opposite the end wall 46 of the suction portion 42 of the securing member 41. The end of the coupling portion includes a bore 45 extending therein for receiving the shaft 40. An outer surface of the shaft 40 and in particular the bulbous end portion of the shaft 40 may frictionally engage an inner surface of the coupling portion 43 defining the bore 45, thereby securing the suction portion 42 of the securing member 41 to the housing 12.

Figure 3:
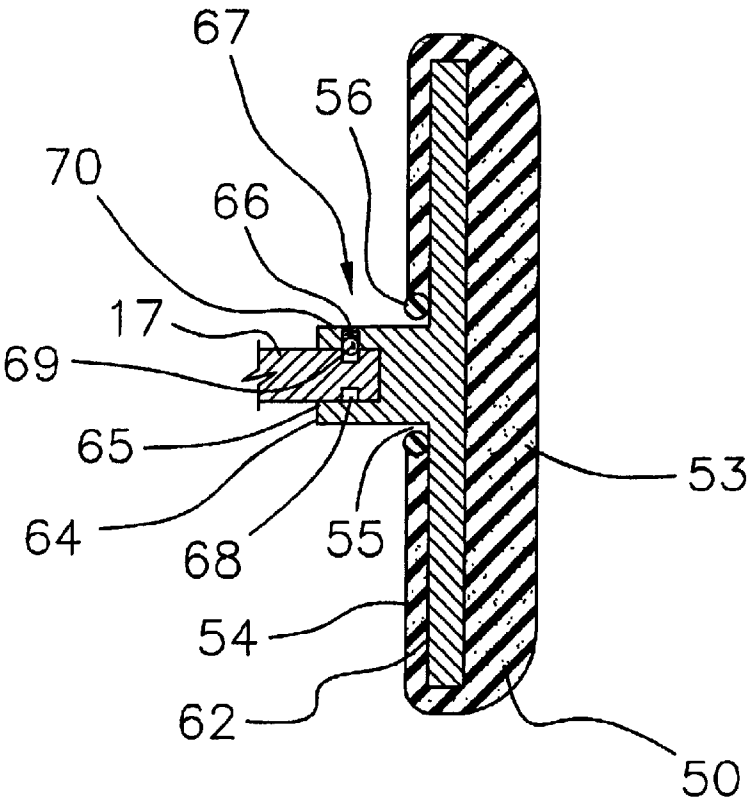
FIG. 3 is a cross sectional view of a cleaning assembly the present invention taken along line 3—3 of FIG. 2.

As illustrated in FIGS. 1, 2 and 3, the cleaning assembly 32 may include a cleaning member 50 for cleaning a body part of a user and a support member 51 for detachably coupling the cleaning member 50 to the motor shaft 17.

As illustrated in FIG. 3, the cleaning member 50 may include a first end wall 53 and a second end wall 54. The second end wall 54 may have an access opening 55 for receiving the support member 51. In one embodiment of the present invention, the first end wall 53 of the cleaning member 50 may have a thickness generally greater than a thickness of the second end wall 54 of the cleaning member 50. The cleaning member 50 may comprise a substantially compressible material such as, for example, a foam material designed for absorbing water and soap. The cleaning member 50 may also comprise a resiliently flexible material such as, for example, a rubber material for massaging a body part of a user. The first end wall 53 of the cleaning member 50 may employ a variety of shapes and contours for cleaning and massaging different parts of a user's body.

As illustrated in FIG. 3, a fastening member 56 may be provided for fastening the cleaning member 50 to the support member 51. The fastening member 56 may be mounted to the second end wall 54 of the cleaning member 50 and may be positionable about the access opening 55. The fastening member 56 may comprise a resiliently flexible material such as, for example, a rubber material. The fastening member 56 preferably constricts the access opening 55 about the support member 51, thereby preventing the cleaning member 50 from detaching from the support member 51.

The support member 51 may include a support portion 60 that has first 61 and second 62 opposed surfaces for inserting into the access opening 55 of the cleaning member 50. The support member 51 may additionally include a coupling portion 63 extending perpendicularly away from the second opposed surface 62 of the support portion 60 for coupling the support portion 60 to the motor shaft 17. The coupling portion 63 has an end 64 that has a bore 65 extending therein defined by a peripheral wall extending between the support portion 60 and the end 64 of the coupling portion 63. The motor shaft 17 is removably positionable in the bore 65 extending into the coupling portion 63 of the support member 51.

In one embodiment of the present invention, a fastening assembly 67 may be mounted in the coupling portion 63 of the support member 51 for releaseably fastening the support member 51 to the motor shaft 17. An inner surface of the peripheral wall of the coupling portion 63 may have a notch 66 extending therein. The fastening assembly 67 may be retractably positioned in the notch 66 for selectively engaging an annular groove 68 extending about the motor shaft 17.

The fastening assembly 67 may include a key 69 that is retractably positionable in the notch 66 of the coupling portion 63 and a biasing member 70 for biasing the key 69 from the notch 66 into the annular groove 68 of the motor shaft 17. The biasing member 70 may be disposed in the notch 66 and positioned between an end surface of the notch 66 and the key 69. The key 69 may have a spherical shape, however, other shapes be employed. The biasing member 70 may comprise a coiled spring, however, other types of springs may also be employed.

In use, the suction portion 42 of the securing assembly 22 is secured to the shaft 40 extending away from the second end wall of the housing 12. The suction portion 42 is then positioned against a wall surface in a desired location. A user then presses the housing 12 against the suction portion 42, thereby suctioning the suction portion 42 to the wall surface. A user may then apply water and a cleaning agent such as, soap to the cleaning member 50. Once the cleaning agent has been applied a user may then select a desired rotational speed of the motor shaft 17 by selecting a particular speed setting of the actuator 20. A user then presses a part of their body they desire to be cleaned against the cleaning member 50. A user can reposition the housing 12 to clean additional body parts. The housing 12 may also be unsecured from the securing assembly 22 and held by a hand of a user to clean various body parts.

Although the present invention has been discussed with reference to particular embodiments it will be understood that other variations-and modifications to the discussed embodiments is possible without departing from the scope of the present invention.

I claim:

1. A positionable body scrubbing device for removably mounting to a wall surface, said device comprising:

a housing having an interior and first and second opposed ends;

a motor being mounted in said interior of said housing, said motor having a motor shaft extending through said first end of said housing;

a power supply being mounted in said housing and electrically connected to said motor for selectively providing power to said motor;

an actuator being mounted on said housing and electrically connected to said motor for selectively controlling said motor;

a securing assembly being mounted to said second end of said housing, said securing assembly being adapted for securing said housing to the wall surface;

a cleaning assembly being rotatably mounted to said motor shaft, wherein a user presses their body against said cleaning assembly;

a door being mounted on said housing for accessing said interior of said housing wherein said door has a foot portion and a leg portion, said foot portion being couplable to said second end of said housing, said leg portion being couplable to a peripheral wall of said housing.

* * * * *